United States Patent [19]

Hayashida

[11] Patent Number: 4,511,770

[45] Date of Patent: Apr. 16, 1985

[54] ROTARY SWITCH

[75] Inventor: Kenji Hayashida, Muko, Japan

[73] Assignee: Hosiden Electronics Co., Ltd., Osaka, Japan

[21] Appl. No.: 561,092

[22] Filed: Dec. 13, 1983

[30] Foreign Application Priority Data

Dec. 28, 1982 [JP] Japan ..... 57-231157

[51] Int. Cl.[3] ..... H01H 19/20; H01H 19/60

[52] U.S. Cl. ..... 200/6 B; 200/6 BB; 200/11 R; 200/61.39; 200/153 LB

[58] Field of Search ..... 200/73, 74, 153 LB, 200/61.39, 6 B, 6 BB

[56] References Cited

U.S. PATENT DOCUMENTS

| | | | |
|---|---|---|---|
| 2,717,345 | 9/1955 | Hileman | 200/153 LB |
| 2,767,268 | 10/1956 | Levine | 200/61.39 |
| 3,131,265 | 4/1964 | Toruk | 200/6 BB |
| 3,428,765 | 2/1969 | Ludwig | 200/61.39 |
| 3,621,162 | 11/1971 | Wall | 200/61.39 |
| 3,975,601 | 8/1976 | Whelan | 200/61.39 |
| 4,282,415 | 8/1981 | Shimizu et al. | 200/6 BB |
| 4,395,604 | 7/1983 | Tominaga | 200/74 |
| 4,455,458 | 6/1984 | Oyama | 200/74 |

*Primary Examiner*—John W. Shepperd

*Attorney, Agent, or Firm*—Pollock, Vande Sande and Priddy

[57] ABSTRACT

As a disc having teeth on its periphery is turned, one end of an engagement piece is engaged with a first lock member, a first protrusion provided on the engagement piece at that end portion is disengaged from the disc, and a second protrusion of the engagement piece at the other end portion thereof is engaged with one of the teeth of the disc. Each time one of the teeth of the disc crosses over the second protrusion, the latter pivots about the point of its engagement with the first lock member, driving the free end of the second resilient piece into and out of contact with the first contact piece. When the disc is turned in the opposite direction, the other end of the engagement piece is engaged with the second lock member to disengage the second protrusion from the disc and to engage the first protrusion with the periphery of the disc. And each time one of the teeth of the disc crosses over the first protrusion, the latter pivots about the point of its engagement with the second lock member, thereby driving the free end of the first resilient piece into and out of contact with the second contact piece.

11 Claims, 6 Drawing Figures

ROTARY SWITCH

BACKGROUND OF THE INVENTION

The present invention relates to a rotary switch which generates pulses in response to its rotation in both forward and backward directions.

Conventional pulse generators of the type generating pulses in response to rotation employ such an arrangement that discriminates the pulses according to the direction of rotation through the use of an electric circuit. Alternatively, a code plate, such as a rotary encoder, is used to detect the rotational angle. The rotary encoder is expensive, and the arrangement for detecting the direction of rotation by means of the electric circuit is relatively complex.

SUMMARY OF THE INVENTION

It is therefore an object of the present invention to provide a rotary switch which is simple in structure and, when connected to a power source, is able to generate independent pulses from different terminals depending on the rotational directions.

According to the present invention, a disc having teeth on its periphery is rotatably housed in a case, and a small engagement piece is disposed adjacent to the teeth of the disc in such a manner as to be pivotally and laterally movable in plain parallel to the disc. The engagement piece has at both ends first and second protrusions for engagement with the teeth of the disc. For engaging the first and second protrusions with the disc, free ends of first and second resilient pieces are pressed against the both ends of the engagement piece toward the teeth of the disc, and a contact piece is disposed opposite to the free end of at least one of the resilient pieces. First and second lock members for engagement with the both ends of the small piece are provided in the case. When the disc is turned in one direction, the small piece is locked by the first lock member to disengage the first protrusion from the teeth of the disc and to engage the second protrusion with the teeth of the disc, and each time one of the teeth of the disc crosses over the second protrusion, the engagement piece performs a pivotal movement about the point of its engagement with the first lock member, by which the second resilient piece is brought into and out of contact with a contact piece confronting therewith, if such a contact piece is present. When the disc is turned in the opposite direction, the engagement piece is brought into engagement with the second lock member to disengage the second protrusion from the teeth of the disc and to engage the first protrusion with the teeth of the disc. And each time one of the teeth of the disc crosses over the first protrusion, the engagement piece performs a pivotal movement about the point of its engagement with the second lock member, by which the first resilient piece is brought into and out of contact with a contact piece confronting therewith, if such a contact piece is present.

BRIEF DESCRIPTION OF THE DRAWINGS

FIG. 5 is a cross-sectional view taken on the line 101—101 in FIG. 4, with the cover on.

DESCRIPTION OF THE PREFERRED EMBODIMENTS

Figure 1:
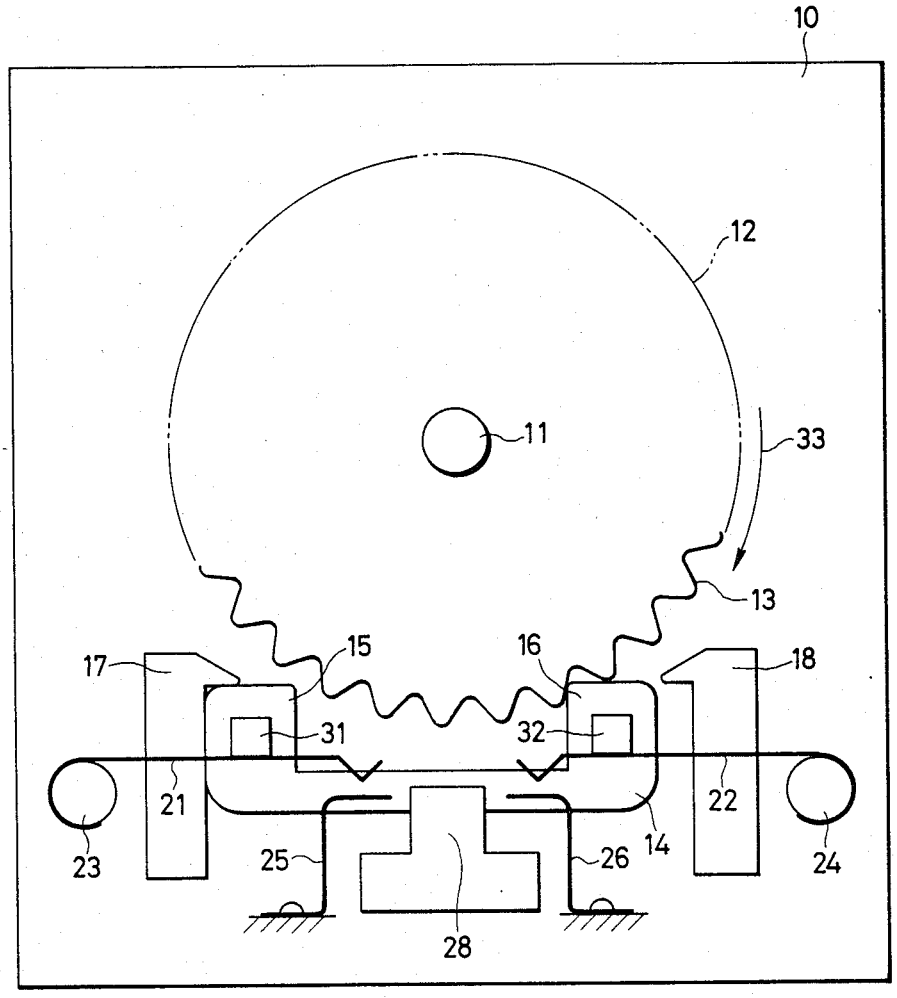
FIG. 1 is a front view explanatory of the principle of the rotary switch of the present invention.

A description will be given first, with reference to the drawings, of the principle of the rotary switch of the present invention. As shown in FIG. 1, a rotary shaft 11 is rotatably mounted on a base plate 10 and a disc 12 is mounted on the rotary shaft 11. The periphery of the disc 12 has formed therein teeth 13 at equiangular intervals, for example, as in the case of a toothed wheel. The spacing and the size of the teeth need not always be the same. A small engagement piece 14 is pressed into contact with the disc 12. The engagement piece 14 is arranged to be movable in the tangential direction of the disc 12 and has at both ends protrusions 15 and 16 for engagement with the teeth 13 of the disc 12.

Further, lock members 17 and 18 are provided on the base plate 10 on both sides of the engagement piece 14 in the direction of its travel. The lock members 17 and 18 are both formed in substantially an inverted L-letter shape relative to the base plate 10. For instance, when locked to the lock member 17, the protrusion 15 cannot be pressed towards the disc 12; namely, the protrusion 15 makes contact with the corner of the inverted L-shaped portion of the lock member 17 and is disengaged from the teeth of the disc 12 and, at the same time, stopped by the lock member 17 from the further movement in the tangential direction of the disc 12 to the left in FIG. 1. Similarly, the protrusion 16, when locked to the lock member 18, cannot be pressed into contact with the disc 12 and is stopped from further movement in the tangential direction of the disc 12 to the right in FIG. 1.

Substantially in parallel to the engagement piece 14 are disposed resilient pieces 21 and 22, by the free end portions of which are biased against the protrusions 15 and 16 in the direction in which to be engaged with the teeth 13 of the disc 12 and in the direction in which to be engaged with the lock members 17 and 18, respectively. The other end portions of the resilient pieces 21 and 22 are fixed to stationary parts 23 and 24, respectively. In the illustrated example, the resilient pieces 21 and 22 are formed by resilient metal pieces, and contact pieces 25 and 26 are provided in opposing relation to free end portions of the resilient pieces 21 and 22 on the side opposite from the disc 12 with respect to them. The engagement piece 14 is held by the base plate 10 and a guide piece 28 secured to the base plate 10 so that it may not fall off the base plate 10. The contact pieces 25 and 26 are also fixed to the base plate 10. On the protrusions 15 and 16 are protrusively provided pawls 31 and 32 on the opposite side from the base plate 10 for engagement with the free ends of the resilient pieces 21 and 22 to bias the engagement piece 14 towards the disc 12.

Figure 2:
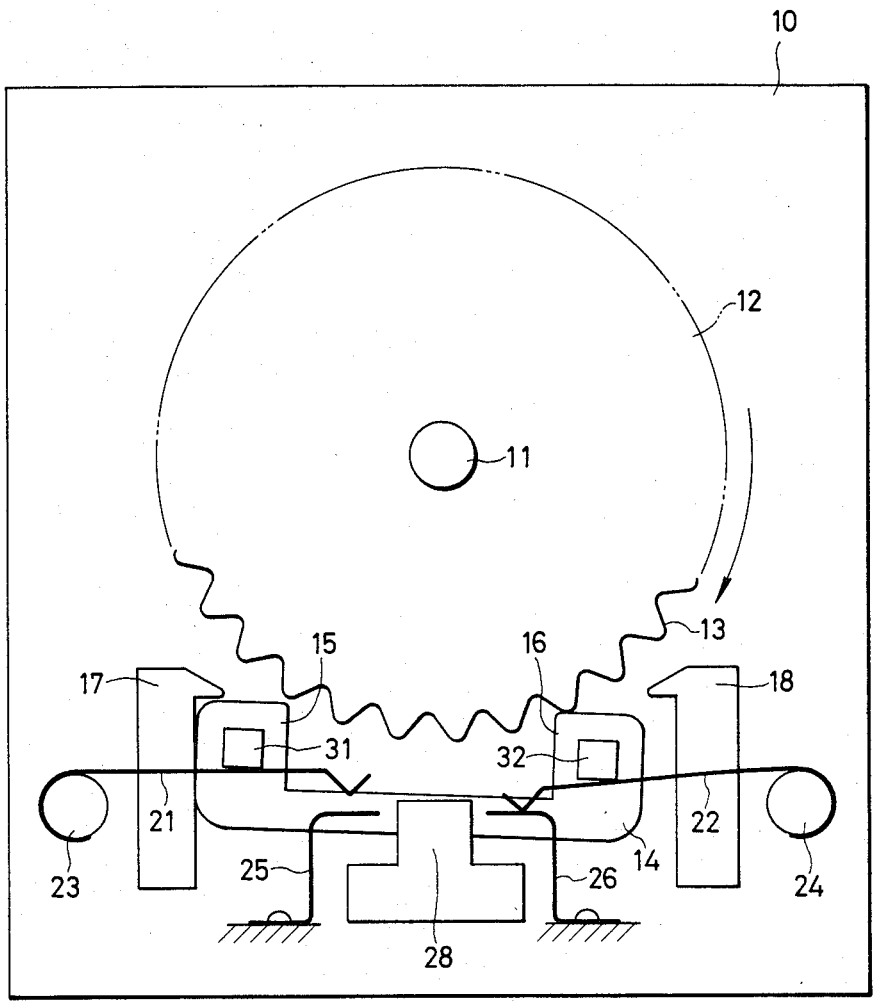
FIGS. 2 and 3 are schematic diagrams respectively showing various operative states of the rotary switch.

In the state shown in FIG. 1 in which the protrusion 15 is in engagement with the lock member 17 and the protrusion 16 is urged into contact with the disc 12, when the disc 12 turns in the clockwise direction as indicated by the arrow 33, the protrusion 16 is pressed down by the tooth 13 against the biasing force of the resilient piece 22 and the engagement piece 14 slightly turns clockwise about the point of engagement between the lock member 17 and the protrusion 15, depressing the free end portion of the resilient piece 22 against its biasing force into resilient contact with the contact piece 26 to turn ON the switch between the resilient piece 22 and the contact piece 26 as shown in FIG. 2.

When the tooth 13 having forced down the protrusion 16 is moved out of contact therewith by further rotational movement of the disc 12, the engagement piece 14 is turned by the resiliency of the resilient piece 22 counterclockwise about the point of engagement between the lock member 17 and the protrusion 15, disengaging the resilient piece 22 from the contact piece 26. In this way, when the disc 12 turns clockwise, the switching ON-OFF operation between the resilient piece 22 and the contact piece 26 takes place once each time a tooth 13 crosses over the protrusion 16, and this ON-OFF operation can be taken out in the form of pulses.

Figure 3:
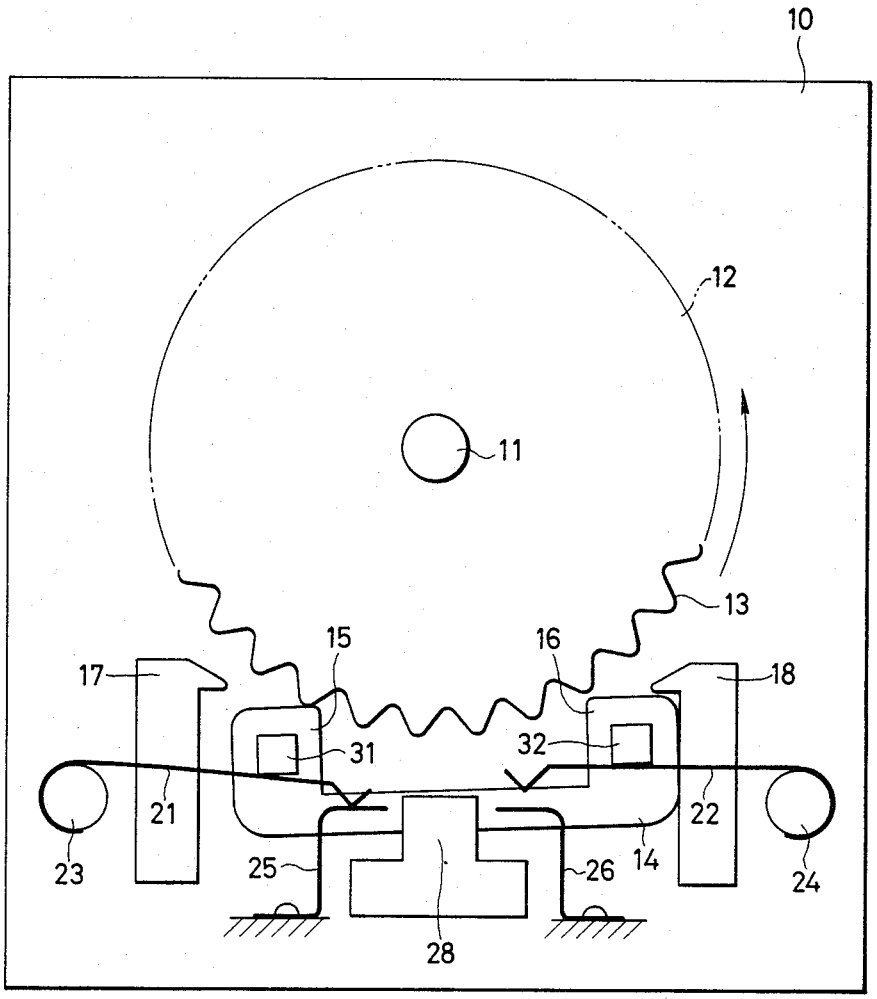

In the state of FIG. 1, when turning the disc 12 counterclockwise, that is, in the direction opposite from the direction of the arrow 33, the engagement piece 14 is moved by the engagement of the protrusion 16 and the tooth 13 in the tangential direction of the disc 12 to the right in FIG. 1, that is, towards the lock member 18, thereby engaging the protrusion 16 with the lock member 18 to disengage the protrusion 16 from the disc 12. At the same time, the protrusion 15 is moved out of contact with the lock member 17 and pressed by the resiliency of the resilient piece 21 into contact with the disc 12 or the tooth 13 thereof. By further rotational movement of the disc 12, the protrusion 15 is forced down against the biasing force of the resilient piece 21, that is, the protrusion 15 slightly turns counterclockwise about the point of engagement between the protrusion 16 and the lock member 18 to engage the resilient piece 21 with the contact piece 25 as shown in FIG. 3. When the tooth 13 having pushed down the protrusion 15 is brought out of contact therewith by further rotational movement of the disc 12, the engagement piece 14 slightly turns clockwise in the drawing, disengaging the resilient piece 21 from the contact piece 25. And each time a tooth 13 crosses over the protrusion 15 as the disc 12 further keeps on turning counterclockwise, the protrusion 15 slightly turns both counterclockwise and clockwise, that is, performs pivotal movements about the point of engagement between the protrusion 16 and the lock member 18, bringing the resilient piece 21 into and out of contact with the contact piece 25 once.

In this way, the switch is turned ON and OFF with respect to either one of the contact pieces 25 and 26 in accordance with the direction of rotational movement of the disc 12, and the direction and amount of rotation of the disc 12 can be detected in the form of pulses.

Figure 4:
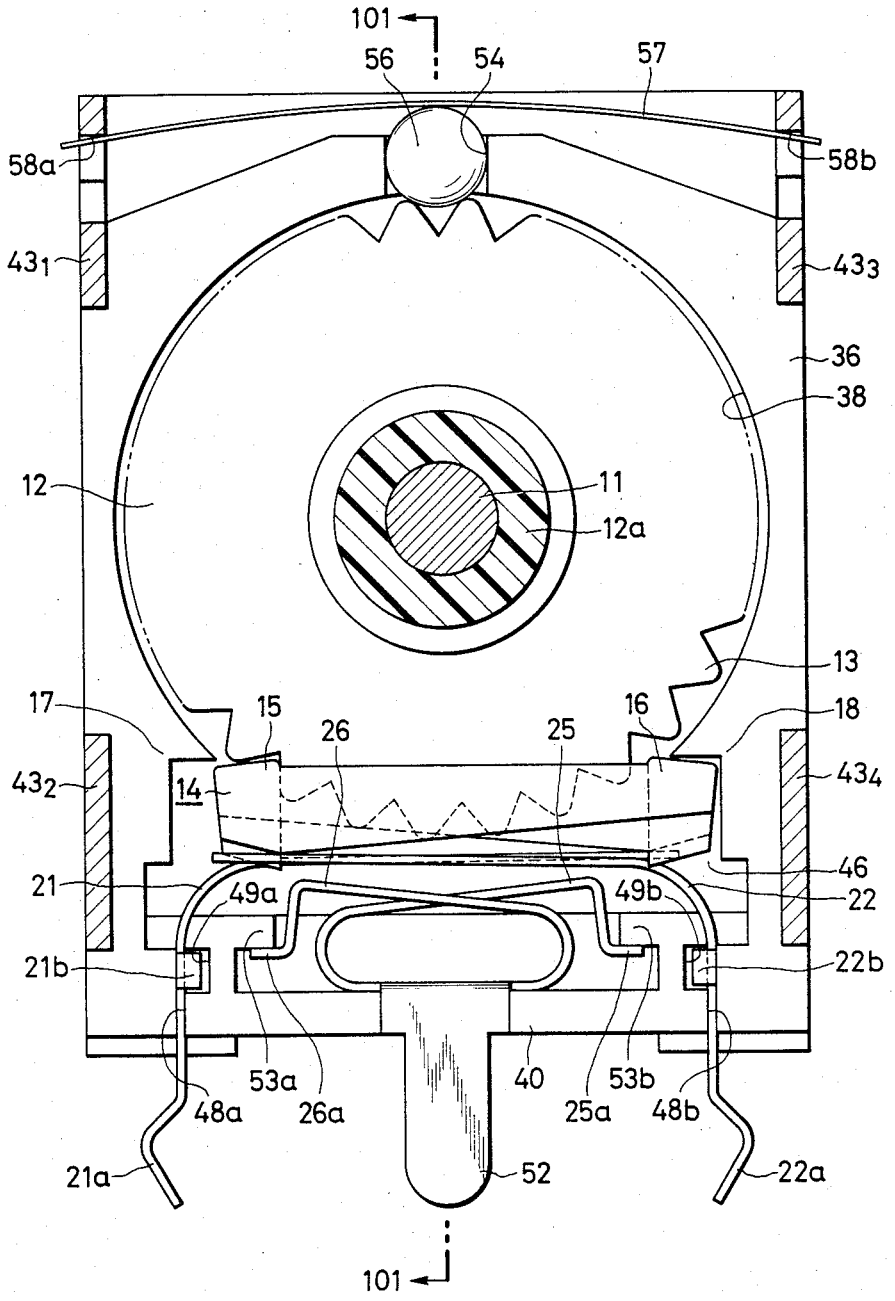
FIG. 4 is a front view illustrating an embodiment of the rotary switch of the present invention, with its cover taken off.
Figure 5:
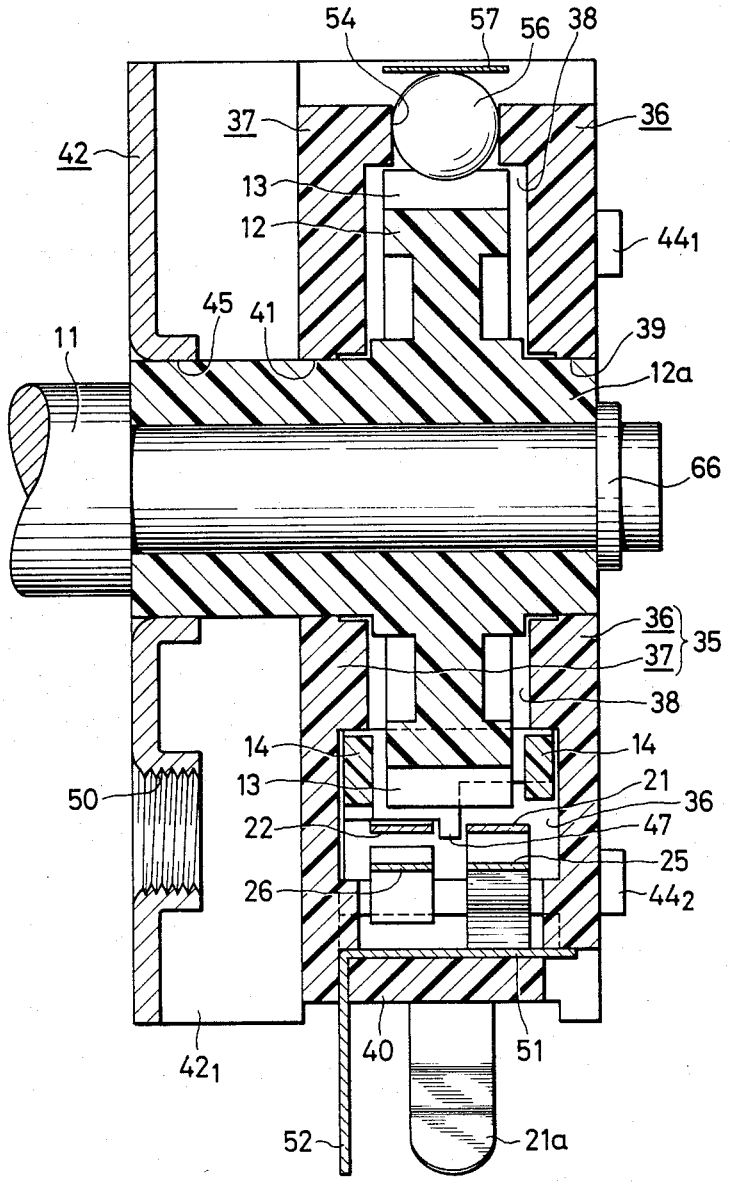
Figure 6:
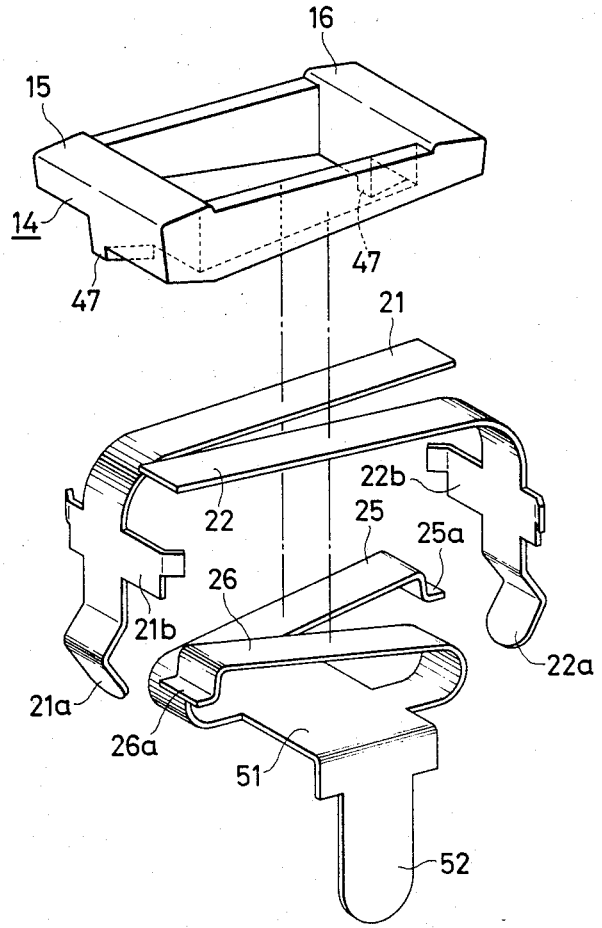
FIG. 6 is an exploded perspective view showing an engagement piece 14, resilient pieces 21 and 22 and contact pieces 25 and 26.

FIGS. 4 to 6 illustrate specific operative examples of the present invention. In FIG. 5, a case 35 of an insulating material is substantially rectangular parallelepipedic in shape and comprised of a case body 36 forming a rear panel of the case 35 and a cover 37 closing the case body 36 to form a front panel of the case 35. As shown in FIG. 4, the case body 36 has a circular recess 38, which has a centrally disposed hole 39 (FIG. 5), and the cover 37 has also a hole 41 centrally disposed thereof in alignment with the hole 39. The disc 12 is disposed in the circular recess 38. The disc 12 has at the center thereof a sleeve **12*a* which is formed as a unitary structure therewith to extend at right angles to the surface thereof. The sleeve 12*a* is inserted into the center holes 39 and 41 and supported by the case 35. A framework 42 made of sheet metal is disposed opposite to the outside of the cover 37. The framework 42 is made in the following manner: A metal plate is cut into such a shape that has four leg portions extending from both end portions of a pair of opposing sides of a square metal plate in parallel to its surface to form an H-like shape, and the marginal portions along the said two opposing sides of the metal plate are bent to form the framework 42 which looks like a square table having four legs $43_1$ to $43_4$. The bent portions form reinforcing side walls $42_1$ and $42_2$ (only the side wall $42_1$ being shown in FIG. 5) each of which couples the two legs of each of the said two opposing sides. The cover 37 and the case body 36 are disposed one on the other between the four legs $43_1$ to $43_4$ as shown in section in FIG. 4. In this manner the framework 42 is mounted on the case 35 with the reinforcing side walls $42_1$ and $42_2$ held in contact with the corresponding edges of the cover 37. Nubs attached to the tips of the legs $43_1$ to $43_4$ are bent inwardly to fixedly secure the cover 37 and the case body 35 by the framework 42**.

The framework 42 has made therein a center hole 45 in alignment with the center hole 41. The inner marginal edge of the hole 45 is extended towards the cover 37 to form a bearing, and the sleeve **12*a* is inserted into the center hole 45 to be held to the framework 42 through the bearing. A rotary shaft 11 is inserted into the sleeve 12*a*, and an E ring 66 is affixed to the projecting end of the rotary shaft 11 to fix thereto the disc 12. The framework 42 has made therein a tapped hole 50** for mounting a rotary switch.

A switch housing compartment 46, which communicates with the circular recess 38, is formed at one side thereof, that is, at the underside of the circular recess 38 in the drawing. The small engagement piece 14 having a square frame-shape is mounted in the switch housing compartment 46 on the side of the circular recess 38 and is pressed into contact with the disc 12. Both ends of the boundary between the circular recess 38 and the switch housing compartment 46 are formed to serve as the aforementioned lock members 17 and 18. In the drawings, the protrusion 16 of the engagement piece 14 is shown to be held in engagement with the lock member 18.

The resilient pieces 21 and 22 are each bent into an inverted L-letter shape and urged against the engagement piece 14. These resilient pieces 21 and 22 are disposed in substantially side-by-side along an axial direction of the shaft 11 but opposing relation to each other. The leg portions of the inverted L-shaped resilient pieces 21 and 22 project out through a side wall 40 of the switch housing compartment 46 on the opposite side from the circular recess 38, forming terminals **21*a* and 22*a*, respectively. The frame-shaped engagement piece 14 has formed integrally therewith a center ridge 47 for keeping the resilient pieces 21 and 22 out of contact with each other as shown in FIG. 6. The side wall 40 has made therein slits 48*a* and 48*b* to extend in parallel to the rotary shaft 11. The terminals 21*a* and 22*a* are inserted into the slits 48*a* and 48*b* from the side of the cover 37 and, in the case 35, the terminals 21*a* and 22*a* respectively have locking pieces 21*b* and 22*b* which are formed integrally therewith to extend therefrom and bent at both end portions as shown in FIG. 6. The locking pieces 21*b* and 22*b* are received by notches 49*a*** and 49*b* formed in the intermediate portions of the slits 48*a* and 48*b* to communicate therewith, respectively, preventing the terminals 21*a* and 22*a* from coming out of the slits 48*a* and 48*b*.

In this example, the contact pieces 25 and 26 are formed as a unitary structure with each other as shown in FIG. 6, and the switches constituted by the contact pieces 25 and 26 and the resilient pieces 21 and 22 use the contact pieces 25, 26 as a common terminal. The contact pieces 25 and 26 are arranged to slope away from each other, to cross each other as viewed from the front and to lie opposite to the resilient pieces 21 and 22, respectively. The base portions of the contact pieces 25 and 26 are coupled integrally with a common plate 51 at opposite sides thereof, and the central portion of one end of the common plate 51 is bent at right angles thereto to extend as a terminal 52 for external connection. In order to keep the spacing between the contact pieces 25 and 26 and the resilient pieces 21 and 22 constant and to obtain a desired contact pressure therebetween, end portions of the contact pieces 25 and 26 are formed as engaging pieces 25*a* and 26*a*, which resiliently engage, from below in FIG. 4, positioning portions 53*a* and 53*b* formed in the case body 36.

The engagement piece 14 is frame-shaped as mentioned previously, and the frame receives a part of the disc 12. A pair of opposing side bars 15, 16 of the frame are used as the protrusions 15, 16 for engagement with the teeth of the disc 12. Each of the side bars 15, 16 has a thicker half portion and a thinner half portion. The frame 14 also has a pair of connecting arms each having a wedge shape with a tapered lower side, for connecting the thicker half portion of one of the pair of the side bars with the thinner half portion of the other of the pair, thus forming a square frame. Each of the side bars 15, 16 has the aforementioned center ridge 47 at the boundary between the thicker and thinner half portions. Each of the resilient pieces 21, 22 extends across an opening of the frame 14 in a direction from the thinner half portion of one of the pair of the bars 15, 16 to the thicker half portion of the other of the pair such that the free end portion of the resilient piece is received by the thicker half portion and a space is provided between the thinner half portion and the resilient piece. This arrangement allows the pivotal movement of the engagement piece 14 for the ON-OFF switching operation either between the resilient piece 21 and the contact piece 25 or between the resilient piece 22 and the contact piece 26, even when both the resilient pieces 21 and 22 are disposed side by side to lie substantially in a common plane.

In order not only to give a distinctive touch by engagement and disengagement between the side bars 15 and 16 and the teeth 13 of the disc 12 by the rotational movement thereof but also to ensure their relative positioning, a ball 56 is disposed in a small hole made in the outer wall of the circular recess 38 on the opposite side from the switch housing compartment 46 and is resiliently urged against the periphery of the disc 12 by means of a plate spring 57 as shown in FIG. 4. The plate spring 57 is engaged at both ends with holes 58*a* and 58*b* made in the both leg portions of the framework 42.

When the disc 12 turns, for example, counterclockwise in FIG. 4, its tooth 13 engages the side bar 15 to slightly turn the engagement piece 14 about the point of its enegagement with the lock member 18, lowering the resilient piece 22 into contact with the contact piece 26 to generate a pulse. Similarly, when the disc 12 turns clockwise, the engagement piece 14 is driven to the left in the drawing to lock the side bar 15 to the lock member 17 and the engagement piece 14 performs pivotal movement about the point of engagement between the side bar 15 and the lock member 17, thereby bringing the free end of the resilient piece 21 into and out of contact with the contact piece 25. The disc 12 is driven, for instance, by a motor. While in the foregoing the switching operation takes place in both directions for each rotational movement of the disc 12, it is also possible to perform the switching operation only in one direction.

As has been described in the foregoing, according to the rotary switch of the present invention, it is possible to generate pulses according to the direction of rotation by interposing the engagement piece 14 between the disc 12 and the resilient pieces 21 and 22. The number of pulses to be produced can be set by a suitable selection of the number of teeth 13. Further, since the resilient pieces bias the engagement piece 14 to push the protrusions, i.e., the side bars in between the teeth of the disc, the switches can normally be held open stably. The rotary switch of the present invention can be reduced in size as a whole by arranging the resilient pieces and the contact pieces in the axial direction of the disc as shown in the embodiment of FIGS. 4 to 6.

It will be apparent that many modifications and variations may be effected without departing from the scope of the novel concepts of the present invention.

What is claimed is:

1. A rotary switch comprising:

a case;

a rotary shaft inserted into the case to be rotatably supported thereto;

a disc having teeth on its periphery and fixedly mounted on the rotary shaft in the case;

an engagement piece having first and second protrusions respectively on the sides of first and second end portions thereof for engagement with the teeth of the disc and disposed adjacent to the disc in the case in a manner to be movable substantially in parallel to the tangential direction of the disc and pivotable about each end portion thereof;

first and second resilient pieces disposed in the case to press at their free ends the first and second protrusions, respectively, against the periphery of the disc;

a first contact piece disposed in the case in opposing relation to the free end portion of the first resilient piece on the opposite side from the disc;

first and second lock members provided in the case for engaging the first and second end portions of the engagement piece, respectively, each in such a manner as to receive the tangential movement of the engagement piece and the pressing force of the engagement piece applied thereto from corresponding one of the first and second resilient pieces;

wherein when the disc is rotated in one direction the engagement piece is driven into a state where the second end portion of the engagement piece is in engagement with the second lock member, the second protrusion is out of engagement with the disc, the first end portion of the engagement piece is out of engagement with the first lock member and the first protrusion is in engagement with the disc, and performs pivotal movement about the second end portion to produce ON-OFF switchings between the first resilient piece and the first contact piece as the teeth of the disc cross over the first protrusion, and when the disc is rotated in the opposite direction the engagement piece is driven into another state where the first end portion of the engagement piece is in engagement with the first lock member, the first protrusion is out of engagement with the disc, the second end portion of the engagement piece is out of engagement with the second lock member and the second protrusion is in engagement with the disc, and performs pivotal movement about the first end portion.

2. A rotary switch according to claim 1, wherein a second contact piece is disposed in the case in opposing relation to the free end portion of the second resilient piece on the opposite side from the disc, and wherein, when the engagement piece is in said another state the engagement piece performs the pivotal movement about the first end portion to produce ON-OFF switchings between the second resilient piece and the second contact piece as the teeth of the disc cross over the second protrusion.

3. A rotary switch according to claim 2, wherein the engagement piece is of a square frame-shape having opposing first and second bars and a pair of opposing arms connecting the first and second bars to form the square frame, the disc is positioned to partly lie between the pair of opposing arms of the frame and substantially in parallel thereto, and the first and second bars of the frame are used as the first and second protrusions.

4. A rotary switch according to claim 3, wherein the first and second resilient pieces are each formed by bending a band-shaped resilient metal plate into an inverted L-letter shape, and the inverted L-shaped first and second resilient pieces are disposed side by side with their horizontal portions extending in opposite directions across the first and second bars of the frame-shaped engagement piece and with the free ends of the horizontal portions of the first and second resilient pieces held in contact with the first and second bars at opposite sides from the disc, respectively, the vertical portions of the inverted L-shaped first and second resilient pieces being led out of the case for external connection.

5. A rotary switch according to claim 4, wherein each of the first and second bars has a thicker half portion and a thinner half portion in a lengthwise direction thereof and the thicker half portions of the first and second bars receive the free ends of the horizontal portions of the first and second resilient pieces, respectively, and there is provided a space each between the thinner half portions of the first and second bars and the first and second resilient pieces.

6. A rotary switch according to claim 4, wherein each of the first and second bars has formed integrally therewith a ridge between the thicker half portion and thinner half portion thereof for separating the first and second resilient pieces from each other.

7. A rotary switch according to claim 2, 3 or 4, wherein the first and second contact pieces are formed as a unitary structure by bending contact piece members extending from opposite sides of a square-shaped, common resilient metal plate, the contact pieces are disposed opposite to the first and second resilient pieces, respectively, and a terminal is led out of the common plate to the outside of the case.

8. A rotary switch according to claim 2, wherein a ball is resiliently urged against the periphery of the disc.

9. A rotary switch according to claim 8, wherein a small hole is made in the case in opposing relation to the periphery of the disc, for housing the ball, and the ball is pressed by a plate spring against the disc from the outside of the case.

10. A rotary switch according to claim 2, wherein a disc housing portion for housing the disc and a switch housing portion communicating therewith are formed in the case, the engagement piece, the first and second resilient pieces and the first and second contact pieces are housed in the switch housing portion, and inner side wall portions of the case at the boundary between the disc housing portion and the switch housing portion are used as the first and second lock members.

11. A rotary switch according to claim 2, wherein the first and second contact pieces are respectively formed by a resilient metal plate, fixed at one end to the case with the other end portions held in opposing relation to the first and second resilient pieces and resiliently biased towards them, and the other end portions of the contact pieces are resiliently engaged with positioning members fixed to the case to receive the resiliently biasing forces of the first and second contact pieces towards the first and second resilient pieces, thereby holding the portions of the first and second contact pieces for contact with the first and second resilient pieces in predetermined adjacent but spaced relation thereto, respectively.

* * * * *